US006321821B1

(12) United States Patent
Wünsche

(10) Patent No.: US 6,321,821 B1
(45) Date of Patent: Nov. 27, 2001

(54) TRAVELER FOR A VERTICAL BLIND

(75) Inventor: Jens Wünsche, Bremerhaven (DE)

(73) Assignee: Benthin Aktiengesellschaft (DE)

( * ) Notice: Subject to any disclaimer, the term of this patent is extended or adjusted under 35 U.S.C. 154(b) by 0 days.

(21) Appl. No.: 09/475,894

(22) Filed: Dec. 30, 1999

(51) Int. Cl.[7] ..... E06B 9/38
(52) U.S. Cl. ..... 160/178.1 V; 160/900
(58) Field of Search ..... 160/173 V, 176.1 V, 160/177 V, 168.1 V, 900, 405, 178.1 V; 29/24.5

(56) References Cited

U.S. PATENT DOCUMENTS 4,103,727 * 8/1978 Spohr ..... 160/168.1 V
4,122,884 * 10/1978 Salzmann ..... 160/900 X
4,140,169 * 2/1979 Arena ..... 160/900 X
4,293,021 * 10/1981 Arena ..... 160/173 V X
4,335,775 * 6/1982 Frentzel et al. ..... 160/168.1 V X
4,350,197 * 9/1982 Haller ..... 160/168.1 V
4,759,397 * 7/1988 Walther ..... 160/176.1 V X
4,834,163 * 5/1989 Dickstein ..... 160/900 X
4,835,848 * 6/1989 Schimmel et al. ..... 29/24.5
4,958,672 * 9/1990 Meyer ..... 160/168.1 V
4,964,191 * 10/1990 Wyatt ..... 160/177 V X
5,445,205 * 8/1995 Hansen ..... 160/168.1 V
6,108,891 * 8/2000 Ruggles et al. ..... 160/168.1 V X

* cited by examiner

*Primary Examiner*—David M. Purol
(74) *Attorney, Agent, or Firm*—McGlew and Tuttle, P.C.

(57) ABSTRACT

A traveler (slat carriage) for a vertical blind is provided with the carriage being movable within a support rail. The traveler includes a main body defining an interior space. The main body has an outer surface defining a gripping pocket. A toothed wheel is disposed in the interior space. A pivot pin is supported in the toothed wheel. The pivot pin and the toothed wheel are together pivotable about a vertical axis. The main body is held form an outside of the main body via the gripping pocket for assembly of the toothed wheel in the space and the pivot pin in the toothed wheel. The invention also provides a traveler (slat carriage) and rail assembly with a support rail, a group of travelers and a drive member. Each of the travelers includes a main body inserted into the rail. A drive member for moving the travelers within the support rail is provided for opening and closing the vertical blind. The drive member is inserted into an orifice of the main body, after assembly of the group of travelers.

25 Claims, 8 Drawing Sheets

TRAVELER FOR A VERTICAL BLIND

FIELD OF THE INVENTION

The present invention pertains to a traveler or slat carriage for a vertical blind and which is movable within a support rail, the traveler (slat carriage) carries a slat of the vertical blind by means of a pivot pin pivotably supported in a main body of the traveler (slat carriage). The pivot pin is supported in a toothed wheel which is pivotably supported in a main body of the traveler (slat carriage). The toothed wheel is driven by worm gear to pivot the pivot pin and, hence, the slat.

BACKGROUND OF THE INVENTION

Travelers (slat carriages) for a vertical blind are well known in the art. They are sold by the BENTHIN Sonnenschutz GmbH, Bremerhaven, Germany in a vertical blind under the trademark DECOMATIC®. In the past such travelers (slat carriages) have been assembled manually. For some years machine assembly of such travelers (slat carriages) has been performed and machines for automatic assembly have been designed. However, the prior art traveler (slat carriage) itself was not re-designed to improve automatic assembly. As a result machines for the automatic assembly work very slowly and malfunctions of the machine occur very often due to the following reasons:

According to the prior art traveler (slat carriage), a stopper for limiting the pivot angle of a pivot pin was allocated to the toothed wheel. As a result, the toothed wheel needed to be inserted into the main body in a certain orientation. Then the pivot pin needed to be inserted into the toothed wheel again with a certain orientation. Hence, two parts of the traveler needed to be inserted in a certain orientation. Furthermore, a pull cord for opening and closing the vertical blind was inserted in an orifice of each traveler. Hence, the pull cord needed to be inserted into the group of travelers, which is needed for the vertical blind, before the group of travelers was inserted into the support rail.

SUMMARY AND OBJECTS OF THE INVENTION

Accordingly, it is an object of the invention to design a traveler (slat carriage) which is optimized for automatic assembly.

According to a first aspect of the invention the traveler or slat carriage comprises a stopper for limiting the pivot angle of the pivot pin, the stopper is allocated to the main body and the pivot pin. Although the toothed wheel may be inserted in the main body with a certain orientation, no certain orientation of the toothed wheel in the main body is required. The pivot pin is then inserted into the toothed wheel in the required orientation. Hence, only one part of the traveler needs to be inserted in a certain orientation.

Preferably, the pivot pin is supported in a toothed wheel by means of a slipping (ratchet) clutch. The pivot pin may a projection co-operation with recesses in the toothed wheel. For further simplifying the assembly of the traveler the number of recesses is by means of design features equal to the number of teeth of the toothed wheel. Preferably, each recess is in alignment to one of the teeth.

According to another design feature of the invention, the worm gear is only of one (single) piece. In contrast thereto the prior art worm gear was of two pieces, an inner sleeve and the worm gear. These two pieces needed to be pre-assembled before the worm gear could be inserted into the main body.

According to a second aspect of the invention a drive member, e.g. pull cord, for opening and closing the vertical blind can be inserted into an orifice of the traveler through a slit in the main body. Hence, the pull cord may be inserted into the orifice before or after the group of travelers has been inserted into the support rail without problems. The width of the slit is smaller than the diameter of the pull cord. This avoids the possibility of the pull cord falling out of the orifice during transport of the blind.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
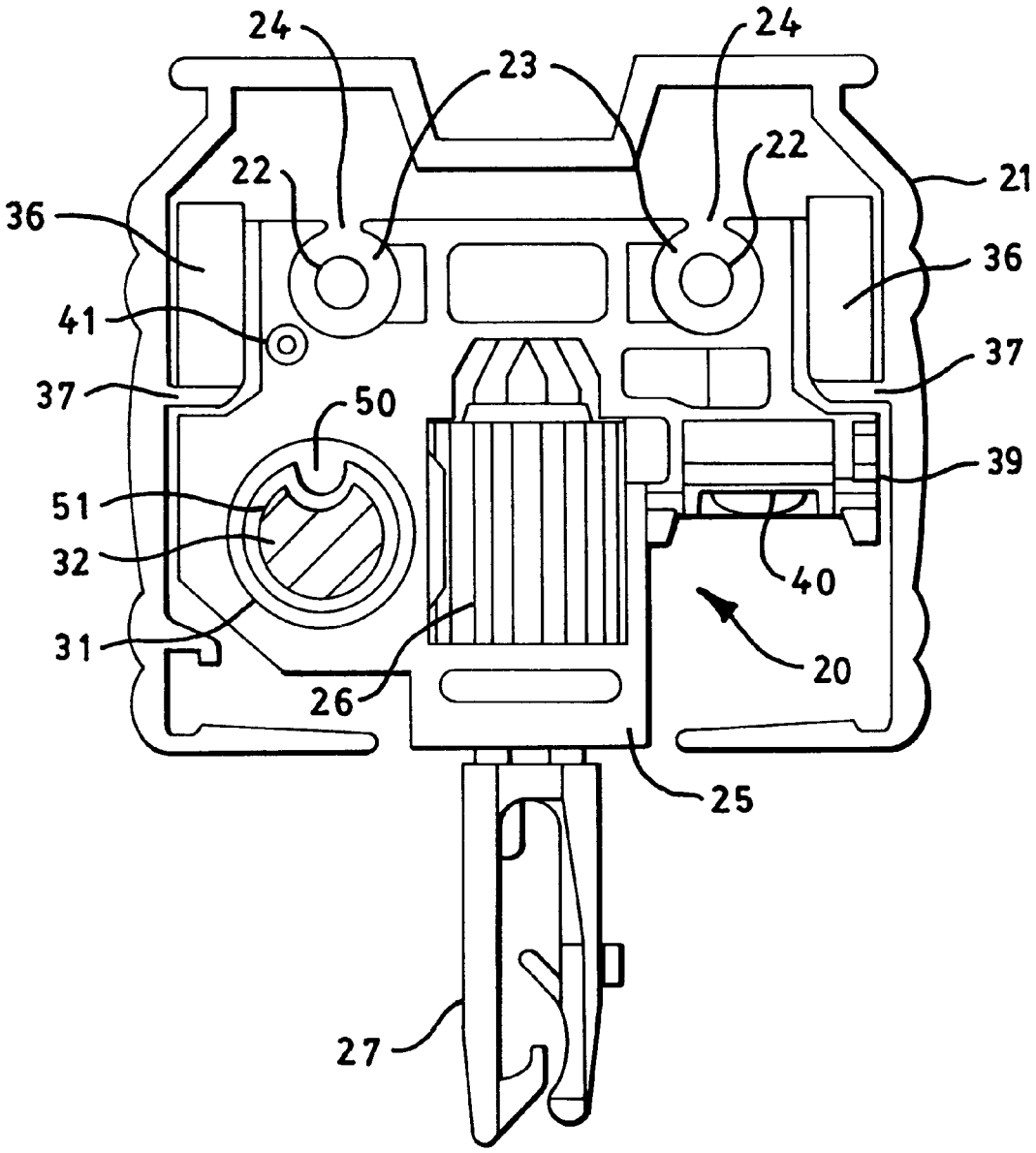
FIG. 1 is a front view of a traveler (slat carriage) in a support rail.
Figure 3:
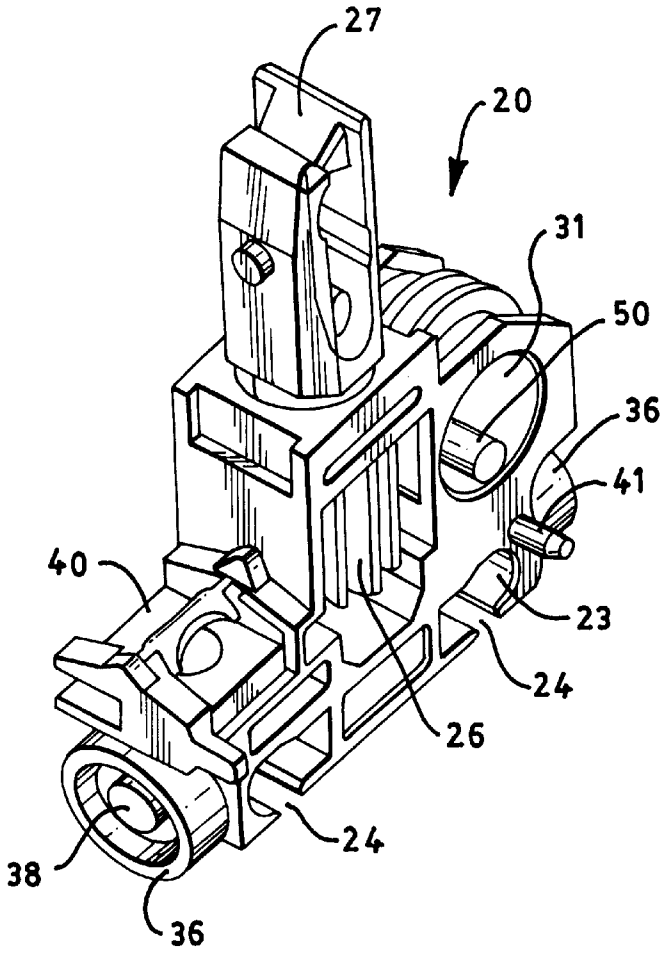
FIG. 3 is a perspective bottom view of the traveler.

A traveler or slat carriage 20 of a vertical blind is movably supported in a support rail 21. To open and close the vertical blind the traveler 20 is moved back and forth within the support rail 21 by means of a pull cord or drive member 22. The pull cord 22 is fixed with its both ends to the first traveler 20 of a group of travelers 20 of the vertical blind. The remaining travelers 20 have the pull cord guided in an orifice 23 as with the traveler 20 shown. As shown in FIG. 1 two orifices 23 are provided in the traveler 20. Each orifice 23 guides one rope of the pull cord 22.

The orifice 23 communicates with the outside through a slit 24. The slit 24 allows the pull cord 22 to be inserted at a very late stage of the assembly of the final vertical blind. Preferably, the pull cord 22 is inserted into the orifice 23 while or immediately before the group of travelers 20 is inserted into to support rail 21. The width of the slit 24 is smaller than the diameter of the pull cord 22.

Figure 8:
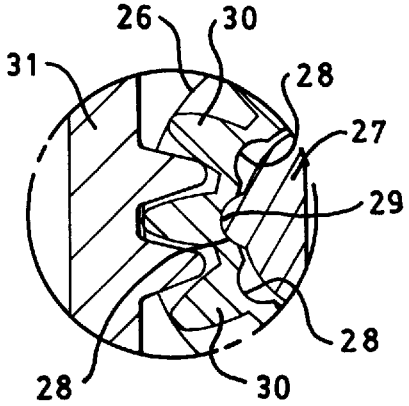
FIG. 8 is an enlarged cross sectional view of the region VIII according to FIG. 7.

The traveler 20 comprises a main body 25 (in which the orifices 23 are arranged). The main body 25 has an interior and provides a space for a transmission mechanism including toothed wheel 26. The toothed wheel 26 is supported in main body 25, rotatable around a vertical axis. The toothed wheel 26 supports a hook like pivot pin 27 which also functions as slat holder. Toothed wheel 26 and pivot pin 27 are secured to one another in a rotating direction by means of a clutch (FIG. 8). The clutch is formed by a number of recesses 28 in an inner axial bore of the toothed wheel 26 and a projection 29 of the pivot pin 27 co-operating with one of the recesses 28. The number of recesses 28 is equal to the number of teeth 30 of the toothed wheel 26. Furthermore, each recess 28 is in alignment with one of the teeth 30. The toothed wheel 26 and, hence, the pivot pin 27 are driven by a worm gear 31 which is driven by pivot shaft 32. The worm gear 31 is rotatably supported in the main body 25. Furthermore, the worm gear 31 is made of a single piece of plastic.

Figure 10:
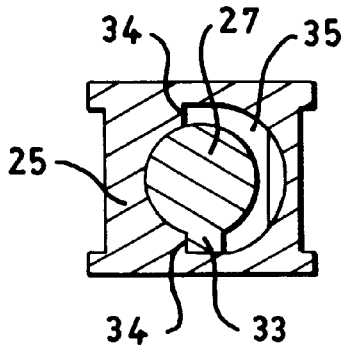
FIG. 10 is a cross sectional view through the traveler according to plane X—X in FIG. 5.

By rotating the pivot shaft 32 the pivot pin 27 and, hence, the slats are pivoted by approximately 180°, from one closed blind position to an other closed blind position. To limit the pivot angle of the pivot pin 27 a stopper is provided (FIG. 10). The stopper is formed by a stopper projection 33 co-operating with stopper faces or contact portions 34 of a stopper groove 35 in the main body 25.

The traveler 20 further comprises wheels 36 rotatably fixed on pins 38 on both sides of the main body 25. The wheels 36 movably support the traveler 20 on support faces 37 of the support rail 21. Since only the first traveler 20 of a group of travelers 20 is driven by the pull cord 22 the travelers 20 are connected by means of distance holders 39 slidably guided in guide slit 40 arranged in the main body 25. Hence, each traveler 20 pulls the following traveler 20 by means of the distance holder 39 when the blind is to be closed. When the blind is to be opened each traveler 20 pushes the following traveler 20. In this situation the travelers are aligned by means of a aligning pin 41 co-operating with a bore hole 42 in the following traveler 20, although the true reason for providing the aligning pin 41 and the bore hole 42 is a easier assembly of a group of travelers 20 as will be described later.

Figure 2:
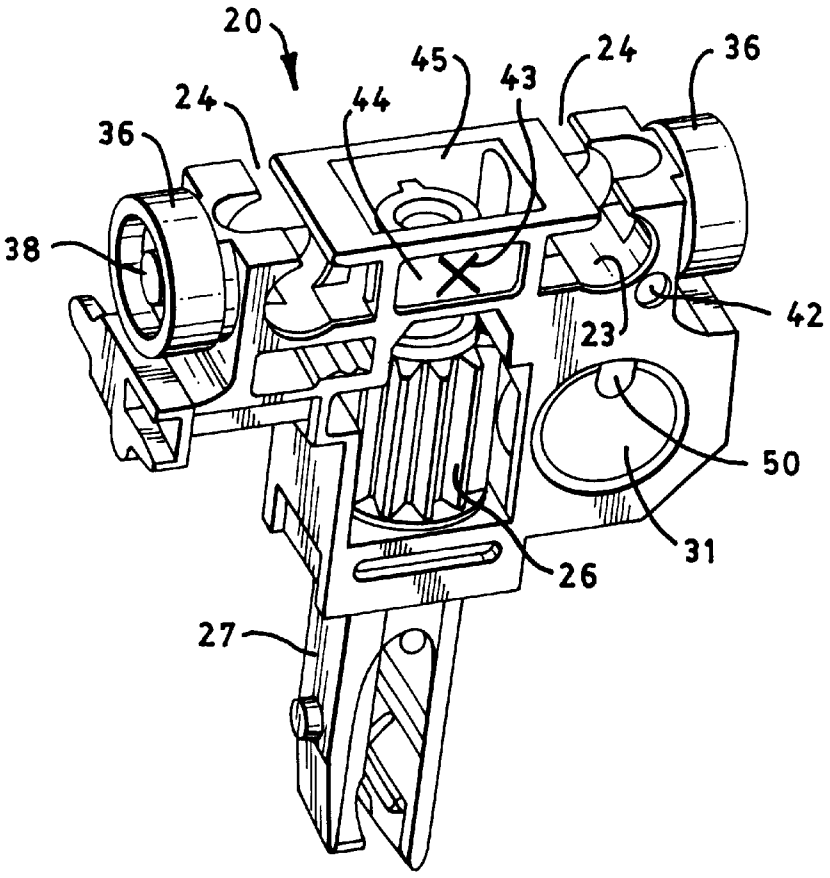
FIG. 2 is a perspective top view of the traveler.

The main body 25 is injection molded. The mold comprises mold segments for manufacturing for example eight main bodies 25 in one injection molding operation. To identify in which mold and which mold segment of the mold a certain main body 25 has been manufactured the main body 25 is provided with a marking 43 (X in FIG. 2). This marking 43 is provided in a pocket 44 of the main body. This ensures that the traveler 20 can be moved to a small package when the blind is open.

On the top of the main body 25 a gripping pocket 45 is provided for gripping the main body 20 by a machine tool while automatically assembling of the traveler 20. The gripping pocket 45 allows free access to the main body 25 for all parts to be assembled to the main body 25, e.g. the toothed wheel 26, the pivot pin 27 and the worm gear 31.

Figure 4:
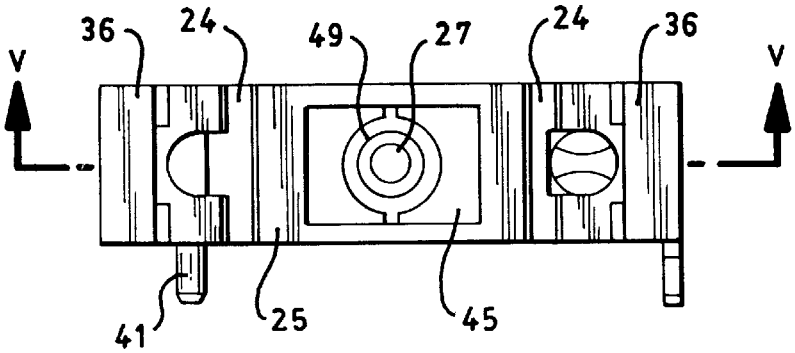
FIG. 4 is a top view of the traveler.
Figure 5:
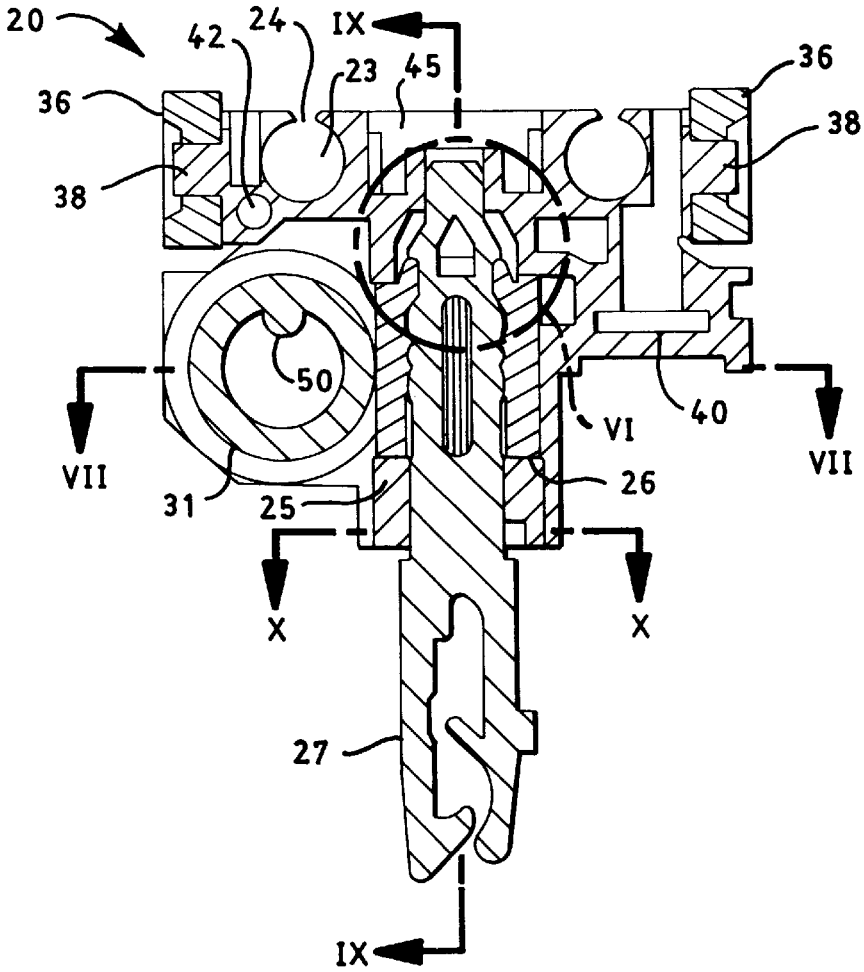
FIG. 5 is cross sectional view taken through the traveler according to plane V—V in FIG. 4.
Figure 7:
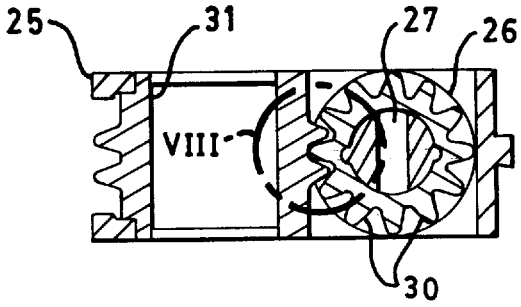
FIG. 7 is a cross sectional view taken through the traveler according to plane VII—VII in FIG. 5.

As can be seen best from FIG. 4, the top of the main body is symmetric to a vertical midplane which is oriented in the moving direction of the traveler 20 within the support rail 21 (plane of cross section IX—IX in FIG. 5).

Figure 6:
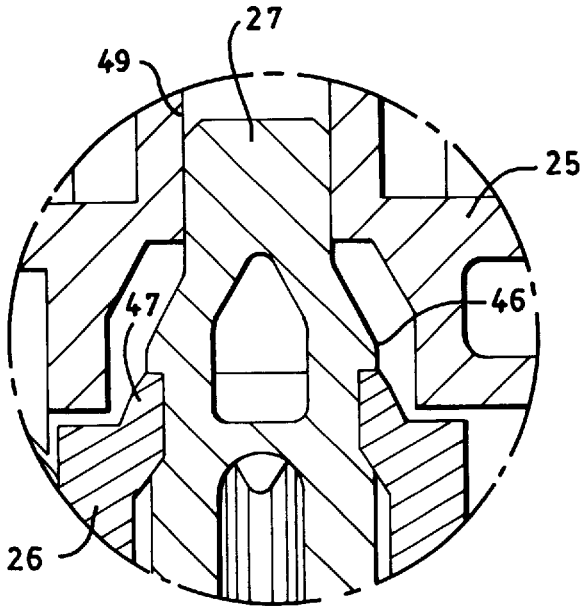
FIG. 6 is an enlarged cross sectional view of the region VI according to FIG. 5.
Figure 9:
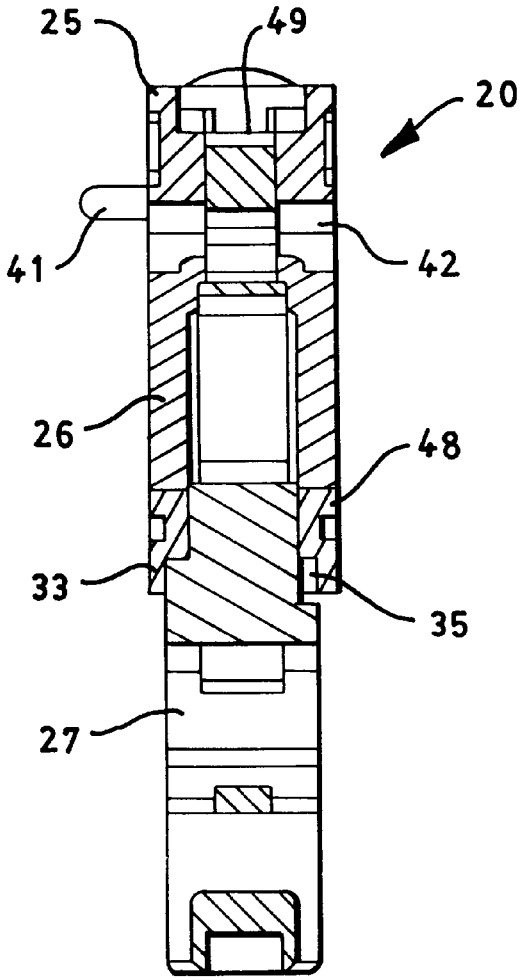
FIG. 9 is a cross sectional view through the traveler according to plane IX—IX in FIG. 5.

The top of the main body 25 contains a boar hole 49 that is provided for receiving the pivot pin 27. An annular projection 46 of the pivot pin 27 cooperates with a snapper 47 of the toothed wheel 26, as shown in FIG. 6.

The traveler is, for example, assembled in the following manner:

The main body is gripped at the gripping pocket 45 by a gripper of the assembly machine. As first or last step the wheels 36 are pinned up on the pins 38. While the wheels 36 are pinned up on the pin 38 a support core is inserted into the orifices 23. The support core avoids deformation or even breakage of the main body 25 due the force applied during pin up of the wheels 26.

Figure 11:
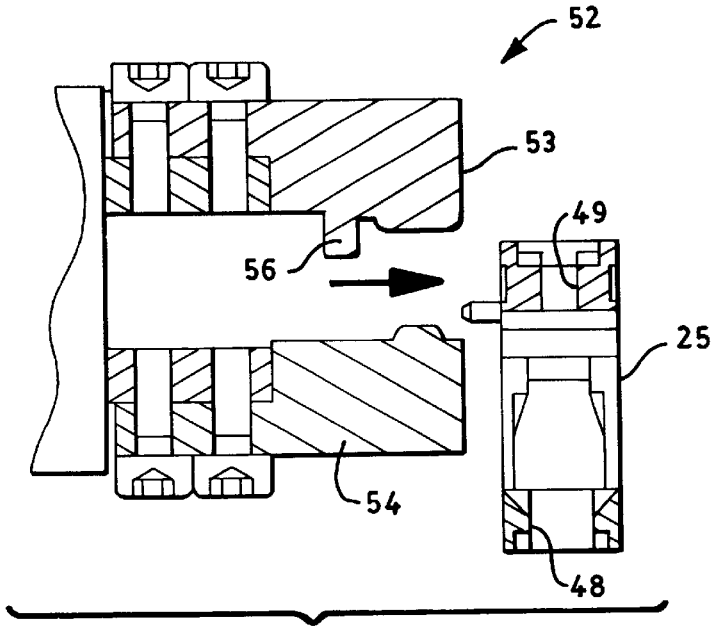
FIG. 11 is a vertical cross sectional view of a gripping tongs for a main body of the traveler in an open position.
Figure 12:
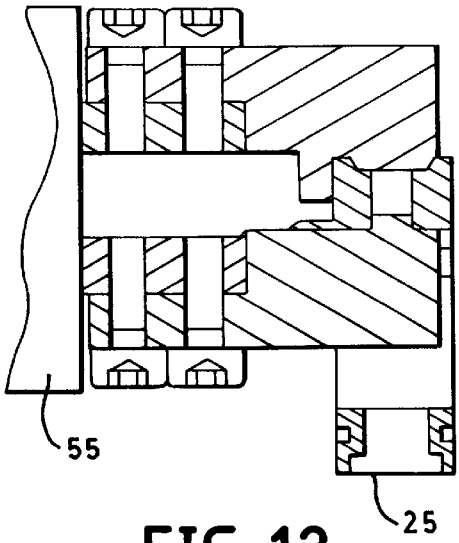
FIG. 12 is a vertical cross sectional view of the gripping tongs for a main body of the traveler in an closed position.
Figure 13:
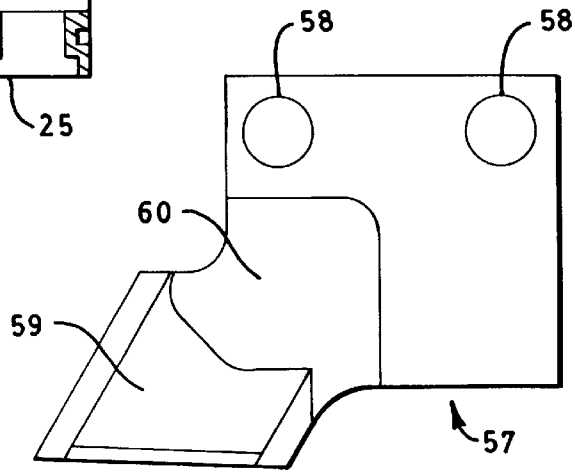
FIG. 13 is a front view of an assembly frame for assembling the traveler.
Figure 14:
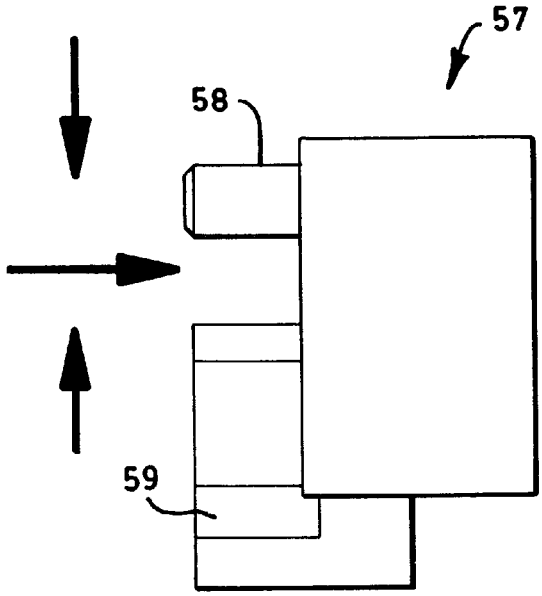
FIG. 14 is a side view of the assembly frame.
Figure 15:
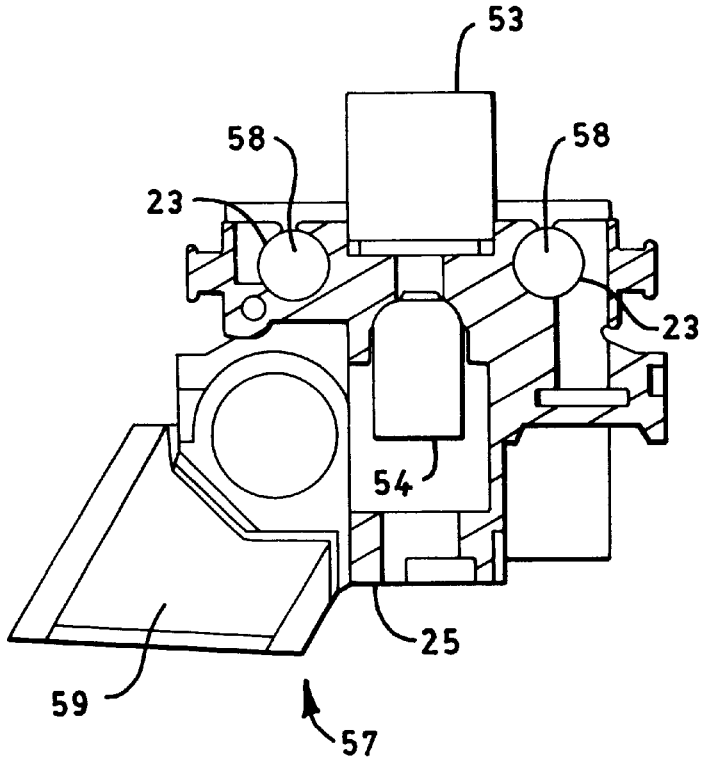
FIG. 15 is a front cross sectional view of the main body laid down in the assembly frame.

Referring to FIGS. 11–17, the traveler 20 described above may be assembled as follows:

The main body 25 is gripped at its gripping pocket 45 via a gripping tongs 52 as shown in FIG. 11, 12 and 15. The gripping tongs 52 have an upper gripping member 53 and a lower gripping member 54 which are slidably mounted to a supporting arm 55 to open and close the gripping tongs 52. The upper gripping member 53 grips into the gripping pocket 45. The upper gripping member 53 further comprises a nose 56 so that the main body 25 is "spanned" in horizontal and vertical direction as shown in FIG. 12. Hence, the main body 25 has a clearly defined position within the gripping tongs 52.

The main body 25 is next laid down in an assembly frame 57 by the gripping tongs 52. The assembly frame 57 comprises two support cores 58. These support cores 58 are inserted into the orifices 23 of the main body 25 when the main body 25 is laid down in the assembly frame 57, thereby guaranteeing a proper position of the main body 25 for further assembly of the traveler 20.

The wheels 36 are pinned up on the pins 38. Thereby the support cores 58 inserted into the orifices 23 avoids deformation or even breakage of the main body 25 due the force applied during pin up of the wheels 36.

The toothed wheel 26 is inserted in the interior of the main body 25 from a front or back side of the main body 25. Next the pivot pin 27 is inserted into the toothed wheel 26 and, hence, the main body 25 through the bore hole 48 in the bottom of the main body (FIG. 16 and 17).

Figure 16:
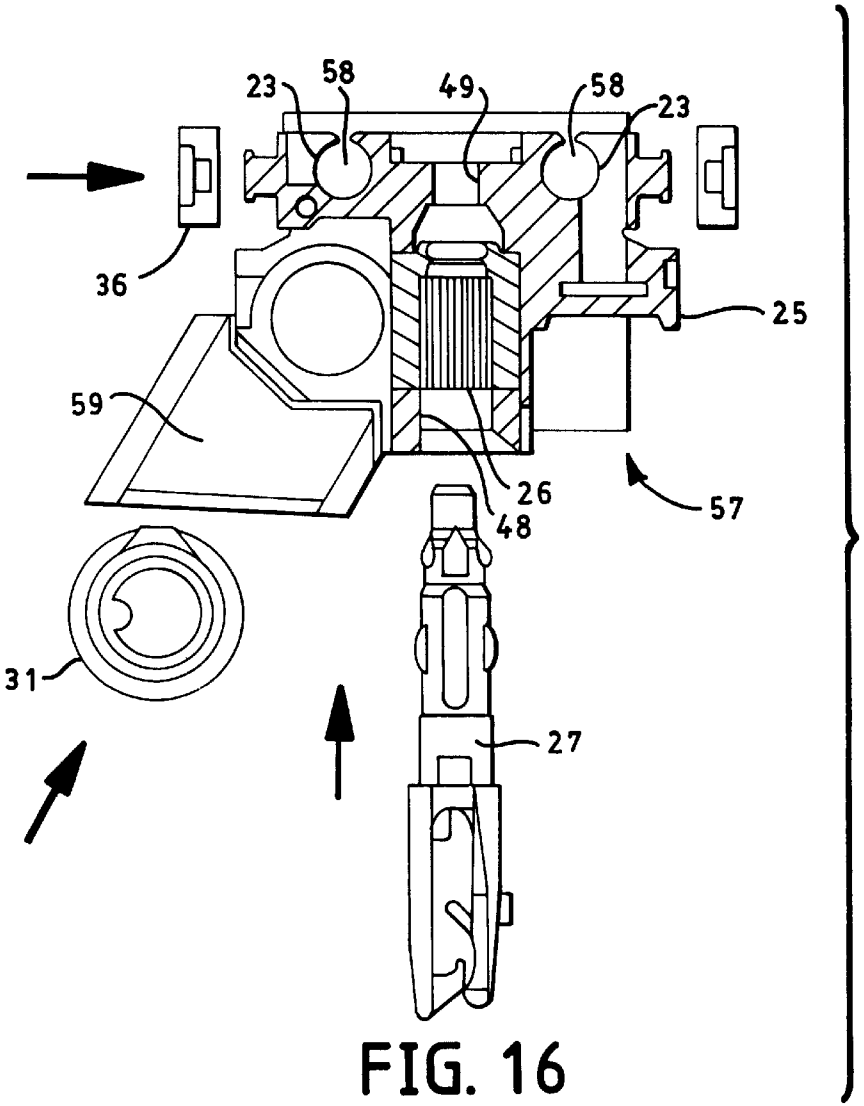
FIG. 16 is a partially sectional front view illustrating the assembly of the traveler.
Figure 17:
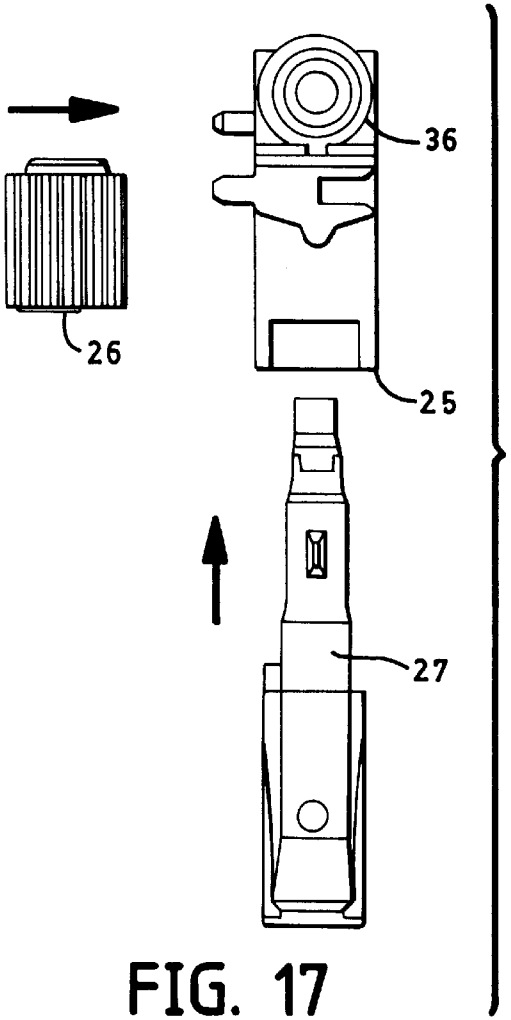
FIG. 17 is side sectional side view illustrating the assembly of the traveler.

After, before or simultaneously to inserting the toothed wheel 26 and the pivot pin 27 the worm gear 31 is inserted into the main body 25 as shown in FIG. 16. The assembly frame 57 is provided with a ramp 59 aligning the worm gear 31 for inserting it into the main body. A recess 60 in the assembly frame 57 allows the assembly frame to open for inserting the worm gear 31.

It is to be appreciated, that the above order of steps for assembly of the traveler 20 may be changed. However, the toothed wheel 26 needs to be inserted before the pivot pin 27 can be inserted.

Furthermore, there is no requirement that a certain orientation of the worm gear, e.g. its driving nose 50, in respect to the orientation of the pivot pin 27 must be meet. The orientation required for operation of the vertical blind is aligned later when the ready assembled travelers 20 are put together to a group of travelers 20. When the travelers 20 are put together to form the group of travelers 20, needed for the vertical blind, the distance holders 39 are assembled to two adjacent travelers 20. The pivot shaft 32 is inserted through the travelers 20, e.g. the worm gears 31. By inserting the pivot shalt 32 the drive noses 50 of worm gears 31 are aligned to one another and to the driving slot 51 of the pivot shaft. The pivot pins 27 are still not aligned to one another as needed for operation of the blind. These are aligned next by turning them within the toothed wheel 26 (using the clutch).

While specific embodiments of the invention have been shown and described in detail to illustrate the application of the principles of the invention, it will be understood that the invention may be embodied otherwise without departing from such principles.

APPENDIX

Reference Numbers:
20 Traveler
21 Support rail
22 Pull cord
23 Orifice
24 Slit
25 Main body
26 Toothed wheel
27 Pivot pin
28 Recess
29 Projection
30 Tooth
31 Worm gear
32 Pivot shaft
33 Stopper projection
34 Stopper face
35 Stopper groove
36 Wheel
37 Support face
38 Pin
39 Distance holder
40 Guide slit
41 Aligning pin
42 Bore hole
43 Marking
44 Pocket
45 Gripping pocket
46 Annular projection
47 Snapper
48 Bore hole
49 Bore hole
50 Driving nose
51 Driving slot
52 gripping tongs
53 upper gripping member
54 lower gripping member
55 supporting arm
56 nose
57 assembly frame
58 support core
59 ramp
60 recess

What is claimed is:

1. A traveler for a vertical blind, the traveler being movable within a support rail, said traveler comprising:

a main body defining an interior space, said main body having an outer surface defining a gripping pocket;

a toothed wheel disposed in said interior space;

a pivot pin connected in said toothed wheel, said pivot pin and said toothed wheel being together pivotable about a vertical axis of said main body;

a gripping tong holding said main body at said gripping pocket whereby said main body receives said toothed wheels and receives said pivot pin through said gripping pocket.

2. The traveler of claim 1, further comprising a clutch wherein said toothed wheel and said pivot pin are fixed to one another by said clutch.

3. The traveler of claim 2, wherein said clutch comprises a projection on said pivot pin and a number of recesses on said toothed wheel cooperating with said projection.

4. The traveler of claim 3, wherein said number of said recesses equals a number of teeth of said toothed wheel.

5. The traveler of claim 4, wherein each of said recesses is in alignment with one of said teeth.

6. The traveler of claim 1, further comprising a worm gear driving said toothed wheel, said worm gear being formed as one piece.

7. The traveler of claim 1, wherein a top side of said main body is symmetric to a vertical midplane of said traveler and is oriented along a moving direction of said traveler.

8. The traveler of claim 1, wherein said gripping pocket is at a top side of said main body, which receives said pivot pin.

9. the traveler of claim 1, further comprising a marking disposed in said main body identifying a mold in which said main body was formed.

10. The traveler of claim 9, further comprising a pocket of said main body having said marking positioned in said pocket.

11. The traveler of claim 1, further comprising a drive member to move said traveler within said support for opening and closing the vertical blind, said main body defining an orifice, said drive member positioned into said orifice of said main body.

12. the traveler of claim 11, wherein said main body defines an access slit which is connected to said orifice of said outside surface of said main body.

13. The traveler of claim 12, wherein said slit is on a top side of a said main body.

14. The traveler of claim 12, wherein said slit has a width smaller than a diameter of said drive member.

15. The traveler of claim 12, further comprising a stopper having a contact portion limiting the pivot angle of said pivot pin relative to said main body, said contact portion disposed within said main body and connected to said pivot pin.

16. A process for assembling a traveler for a vertical blind, the process comprising:

providing a main body defining an interior space, the main body having an outer surface defining a gripping pocket;

providing a toothed wheel;

providing a pivot pin;

holding the main body from an outside of the main body through the gripping pocket;

laying the main body into an assembly frame while holding the main body;

disposing the toothed wheel in the interior space and connecting a portion of the pivot pin in the toothed wheel with the main body in the assembly frame.

17. The process according to claim 16, wherein said step of holding the main body from an outside of the main body through the gripping pocket includes using gripping tongs for gripping the main body at the gripping pocket.

18. The process according to claim 17, wherein the gripping tongs have an upper gripping member and a lower gripping member which are slidably mounted to a supporting arm to open and close the gripping tongs, and the upper gripping member grips into the gripping pocket and the upper gripping member further comprises a nose to support the main body in a horizontal and vertical direction to provide the main body in a clearly defined position.

19. The process according to claim 16, wherein the assembly frame has two support cores, the support cores being inserted into orifices of the main body when the main body is laid in the assembly frame, thereby properly positioning the main body for further assembly of the traveler.

20. The process according to claim 18, further comprising pining up wheels on pins of the main body, whereby the support cores inserted into the orifices of the main body avoid deformation of the main body due the force applied during pin up of the wheels.

21. The process according to claim 16, wherein the toothed wheels is inserted into the interior of the main body from a front or back side of the main body and the pivot pin is subsequently inserted into the toothed wheel and into the main body through a bore hole in a bottom of the main body.

22. The process according to claim 21, further comprising:

aligning the worm gear for inserting it into the main body including providing a recess in the assembly from for opening the assembly frame for inserting the worm gear.

23. The process according to claim 21, further comprising:

inserting a worm gear into the main body after said worm gear is inserted into the toothed wheels and the pivot pin.

24. The process according to claim 21, further comprising:

inserting a worm gear into the main body before said worm gear is inserted into the toothed wheel and the pivot pin.

25. The process according to claim 21, further comprising:

inserting a worm gear into the main body while said worm gear is inserted into the toothed wheel and the pivot pin.

* * * * *